US007496323B2

(12) United States Patent
Kataoka et al.

(10) Patent No.: US 7,496,323 B2
(45) Date of Patent: Feb. 24, 2009

(54) LUBRICANT APPLYING UNIT, PROCESS CARTRIDGE, AND IMAGE FORMING APPARATUS

(75) Inventors: Chohtaroh Kataoka, Tokyo (JP); Shinichi Kawahara, Tokyo (JP); Takeo Suda, Tokyo (JP); Takaaki Tawada, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 10/927,045

(22) Filed: Aug. 27, 2004

(65) Prior Publication Data

US 2005/0084304 A1 Apr. 21, 2005

(30) Foreign Application Priority Data

Aug. 29, 2003 (JP) ..... 2003-306590
Jul. 6, 2004 (JP) ..... 2004-199065

(51) Int. Cl.
*G03G 15/20* (2006.01)

(52) U.S. Cl. ..... 399/346; 399/176; 399/324; 399/325

(58) Field of Classification Search ..... 399/346
See application file for complete search history.

(56) References Cited

U.S. PATENT DOCUMENTS 4,252,882 A * 2/1981 Herrmann ..... 399/346
5,162,856 A * 11/1992 Hayashida et al. ..... 399/346
5,469,247 A * 11/1995 Cheng et al. ..... 399/346
5,493,365 A 2/1996 Matsui et al.
5,596,395 A 1/1997 Sawamura et al.
5,610,691 A 3/1997 Takahashi et al.
5,678,125 A 10/1997 Kutsuwada et al.
5,815,767 A 9/1998 Kutsuwada et al.
5,887,224 A 3/1999 Mizuishi et al.
5,909,609 A 6/1999 Yahata et al.
5,923,936 A 7/1999 Tanoue et al.
5,950,062 A 9/1999 Yahata et al.
6,055,388 A 4/2000 Watanabe et al.
6,055,394 A 4/2000 Suda et al.
6,060,205 A * 5/2000 Takeichi et al. ..... 399/346
6,097,914 A 8/2000 Tanaka et al.

(Continued)

FOREIGN PATENT DOCUMENTS

JP 61231562 A * 10/1986

(Continued)

OTHER PUBLICATIONS

U.S. Appl. No. 10/588,957, filed Aug. 10, 2006, Suda et al.

(Continued)

*Primary Examiner*—David M Gray
*Assistant Examiner*—Ryan D Walsh
(74) *Attorney, Agent, or Firm*—Oblon, Spivak, McClelland, Maier & Neustadt, P.C.

(57) ABSTRACT

A lubricant applying unit includes application mechanism that applies a lubricant from a solid lubricant on a surface of an image carrier that carries an image. The lubricant is a silicon-based-powder or a silicon-based-granule. Since the lubricant is less likely to adhere on a charging member that comes in contact with the image carrier, insufficient charge in the charging roller can be prevented, and a lifetime of the charging roller increases.

12 Claims, 2 Drawing Sheets

U.S. PATENT DOCUMENTS

| | | | | |
|---|---|---|---|---|
| 6,101,351 | A | 8/2000 | Suda et al. | |
| 6,256,465 | B1 | 7/2001 | Yoshinaga et al. | |
| 6,336,013 | B1 | 1/2002 | Suda et al. | |
| 6,337,957 | B1 | 1/2002 | Tamaki et al. | |
| 6,415,129 | B2 * | 7/2002 | Sawayama | 399/353 |
| 6,463,237 | B2 | 10/2002 | Suda et al. | |
| 6,495,649 | B2 * | 12/2002 | Harada et al. | 528/39 |
| 6,522,855 | B1 | 2/2003 | Katoh et al. | |
| 6,560,414 | B2 | 5/2003 | Suda et al. | |
| 6,611,671 | B2 * | 8/2003 | Shoji | 399/346 |
| 6,751,427 | B2 * | 6/2004 | Sugiura | 399/176 |
| 6,763,208 | B2 | 7/2004 | Nagatsuna et al. | |
| 2001/0044059 | A1 * | 11/2001 | Miyamoto et al. | 430/45 |
| 2001/0051054 | A1 * | 12/2001 | Sawada | 399/176 |

FOREIGN PATENT DOCUMENTS

| | | |
|---|---|---|
| JP | 7-210051 | 8/1995 |
| JP | 2001-51550 | 2/2001 |

OTHER PUBLICATIONS

U.S. Appl. No. 11/508,238, filed Aug. 23, 2006, Kawahara et al.
U.S. Appl. No. 11/853,529, filed Sep. 11, 2007, Kawahara et al.

* cited by examiner

LUBRICANT APPLYING UNIT, PROCESS CARTRIDGE, AND IMAGE FORMING APPARATUS

CROSS-REFERENCE TO RELATED APPLICATIONS

The present document incorporates by reference the entire contents of Japanese priority documents, 2003-306590 filed in Japan on Aug. 29, 2003 and 2004-199065 filed in Japan on Jul. 6, 2004.

BACKGROUND OF THE INVENTION

1) Field of the Invention

The present invention relates to a lubricant applying unit, a process cartridge, and an image forming apparatus.

2) Description of the Related Art

Conventionally, an image forming apparatus employs an image forming process of an electrophotographic method to form an image. A toner image is formed on an image carrier (such as a drum-like photosensitive element and a belt-like intermediate transfer body) charged by a charging unit the toner image is transferred onto a recording medium. A cleaning blade is abutted on the surface of the image carrier after the transfer of the toner image to remove the residual toner remaining on the surface of the image carrier.

Since the cleaning blade is abutted on the surface of the image carrier, the image carrier and the cleaning blade are worn out with use over time. Therefore, it is desirable that a lubricant is supplied onto the surface of the image carrier to relief friction on the surface of the image carrier.

A method for supplying the lubricant is disclosed in, for example, Japanese Patent Application Laid-Open No. H7-210051 and Japanese Patent Application Laid-Open No. 2001-51550. A cleaning brush that comes in contact with the surface of the image carrier rotates around the axis. A solid lubricant is abutted on a circumference of the cleaning brush, so that some lubricant rubbed off from the solid lubricant by the cleaning brush is applied on the surface of the image carrier.

As the lubricant, zinc stearate is generally used. The zinc stearate is likely to adhere to the charging unit. When the zinc stearate adheres on the charging unit, resistance of the entire charging unit can be changed. As a result, charge in the charging unit may become insufficient. It is not possible to suppress the adhesion of the lubricant to the charging unit with the techniques disclosed in the above patent literatures.

If the charging unit is not sufficiently charged, image quality is degraded because the image carrier cannot be uniformly charged. If the zinc stearate is used as the lubricant, the insufficient charge frequently occurs, and consequently, frequent maintenance to remove the adhered lubricant becomes necessary to keep the image quality. This shortens a lifetime of the charging unit.

SUMMARY OF THE INVENTION

It is an object of the present invention to solve at least the above problems in the conventional technology.

A lubricant applying unit according to one aspect of the present invention includes an application mechanism that applies a lubricant on a surface of an image carrier that carries an image, and the lubricant is a silicon-based-powder or a silicon-based-granule.

A process cartridge according to another aspect of the present invention includes an image carrier that carries an image; a cartridge case that holds the image carrier in such a manner that the image carrier is freely revolved; and a lubricant applying unit that is held in the cartridge case, the lubricant applying unit including an application mechanism that applies a lubricant on a surface of an image carrier that carries an image. The lubricant is a silicon-based-powder or a silicon-based-granule.

An image forming apparatus according to still another aspect of the present invention includes a process cartridge that is detachably mounted on the image forming apparatus, the process cartridge including an image carrier that carries an image, a cartridge case that holds the image carrier in such a manner that the image carrier is freely revolved, and a lubricant applying unit that is held in the cartridge case, the lubricant applying unit including an application mechanism that applies a lubricant on a surface of an image carrier that carries an image, the lubricant being a silicon-based-powder or a silicon-based-granule; a charging unit that charges the surface of the image carrier based on image data; an optical writing unit that performs optical writing on the surface of the image carrier charged; a developing unit that supplies a toner onto the surface of the image carrier, on which the optical writing has been performed, to form a toner image; a transfer unit that transfers the toner image formed on the surface of the image carrier onto a recording medium; a fixing unit that fixes the toner image transferred onto the recording medium; and a first cleaning unit that cleans the surface of the image carrier.

An image forming apparatus according to still another aspect of the present invention includes an image carrier that carries an image; a lubricant applying unit that includes an application mechanism that applies a lubricant on a surface of the image carrier, the lubricant being a silicon-based-powder or a silicon-based-granule; a charging unit that charges a surface of the image carrier based on image data; an optical writing unit that performs optical writing on the surface of the image carrier charged; a developing unit that supplies a toner onto the surface of the image carrier, on which optical writing has been performed, to form a toner image; a transfer unit that transfers the toner image formed on the surface of the image carrier onto a recording medium; a fixing unit that fixes the toner image transferred on the recording medium; and a first cleaning unit that cleans the surface of the image carrier.

The other objects, features, and advantages of the present invention are specifically set forth in or will become apparent from the following detailed description of the invention when read in conjunction with the accompanying drawings.

DETAILED DESCRIPTION

Figure 1:
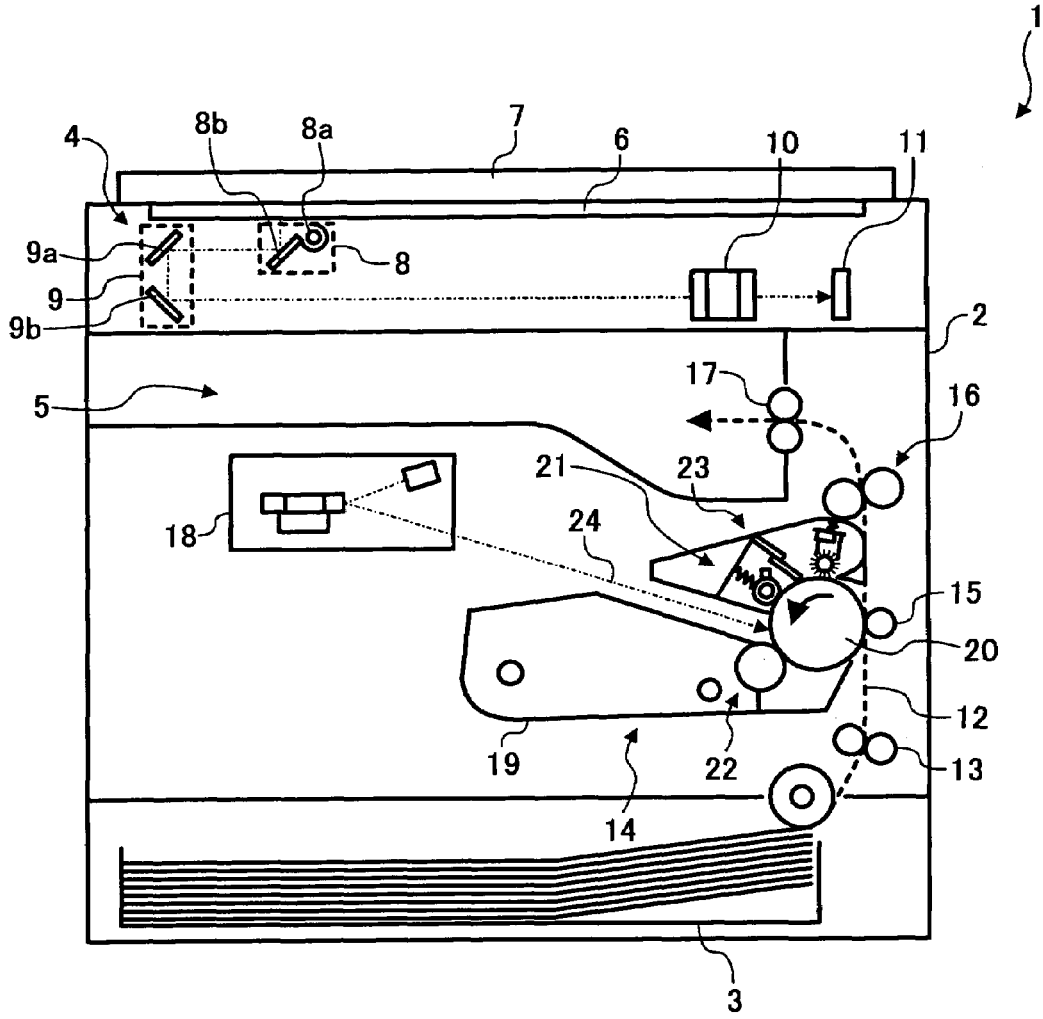
FIG. 1 is a cross section of a copier as an example of an image forming apparatus.
Figure 2:
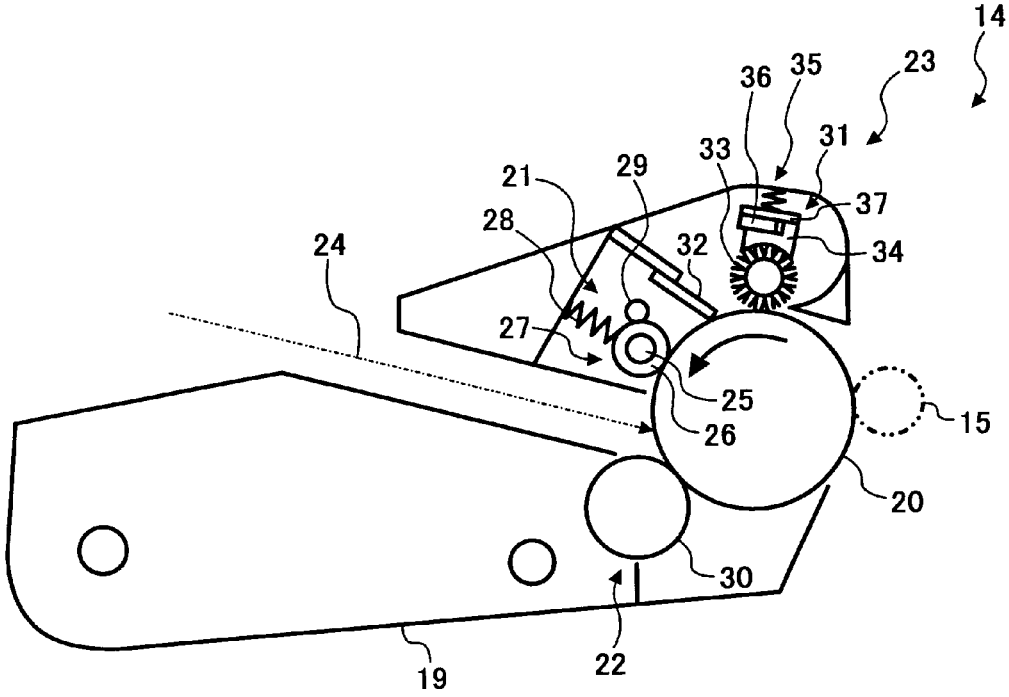
FIG. 2 is a cross section of a process cartridge that is included in the copier.
Figure 3:
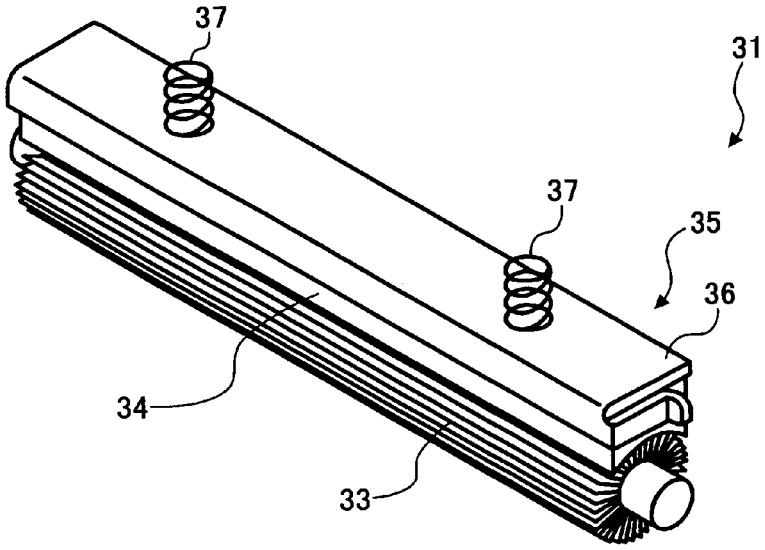
FIG. 3 is a perspective view of a lubricant applying unit that is included in the process cartridge.

Exemplary embodiments of a lubricant applying unit, a process cartridge, and an image forming apparatus according to the present invention will be explained in detail below with reference to the accompanying drawings. FIG. 1 is a cross section of a copier that is an image forming apparatus. FIG. 2 is a cross section of a process cartridge that is included in the copier. FIG. 3 is a perspective view of a lubricant applying unit that is included in the process cartridge.

As shown in FIG. 1, in a lower part of a main unit 2 of a copier 1, a recording medium storage 3 that stores a recording medium, such as paper, is arranged, and an image reader 4 is arranged in an upper part of the main unit 2. A recording medium outlet 5 is arranged below the image reader 4 that ejects the recording medium on which an image has been formed.

The image reader 4 includes a contact glass 6, a platen 7 that holds down an original document placed on the contact glass 6, a first and a second traveling bodies 8 and 9 that reciprocate in the direction of an arrow at a speed ratio of 2:1 for reading the image on the original document on the contact glass 6, a lens 10, and a charge coupled device (CCD) 11. The image on the original document placed on the contact glass 6 is illuminated by a lamp 8*a* in the first traveling body 8, and reflected light of which is sequentially reflected by a mirror 8*b* in the first traveling body 8, and mirrors 9*a* and 9*b* in the second traveling body 9. Then, the image is read by the CCD 11 via the lens 10 to be converted into an image signal. The image signal is turned into image data through image processing such as digitization.

A recording medium carrier path 12 is formed to lead a recording medium from the recording medium storage 3 to the recording medium outlet 5. On the recording medium carrier path 12, a resist roller 13, a process cartridge 14, a transfer unit 15, a fixing unit 16, and an ejection roller 17 are arranged. Furthermore, an optical writing unit 18 that emits laser beams corresponding to the image data is arranged in the main unit 2.

The process cartridge 14 includes a cartridge case 19, a drum-like photosensitive element 20 that is an image carrier rotatably held in the cartridge case 19, a charging unit 21 that is arranged around the photosensitive element 20 in the cartridge case 19, a developing unit 22, a cleaning unit 23, and the like. The process cartridge 14 is detachably installed in the main unit 2. A slit 24 through which the laser beam emitted from the optical writing unit 18 is irradiated toward the surface of the photosensitive element 20 is formed in the cartridge case 19 along the axial direction of the photosensitive element 20.

The charging unit 21 includes a charging roller 27 that is a charging unit having a rubber layer 26 around a core metal 25, a spring 28 that makes the charging roller 27 abut against the photosensitive element 20, and the like. A charge cleaning roller 29 that cleans foreign matter adhered on the surface of the charging roller 27 is arranged on a circumference of the charging roller 27. The charge cleaning roller 29 cleans a lubricant adhered on the surface of the charging roller 27. Therefore, it is possible to increase a life of the charging roller 27.

The charge cleaning roller 29 is a rotor that is rotatably arranged in such a manner that the charge cleaning roller 29 comes in contact with the charging roller 27. Consequently, the lubricant adhered on the charging roller 27 can be efficiently removed. As a result, it becomes possible to maintain a high quality image over a long period of time. More specifically, the charge cleaning roller 29 is arranged in such a manner that a center axis of the charge cleaning roller 29 is parallel to a center axis of the charging roller 27. A periphery of the charge cleaning roller 29 contacts with the surface of the charging roller 27, and is rotatable corresponding to rotation of the charging roller 27. The charge cleaning roller 29 is formed with a foam, a brush, or the like.

In the embodiment, the charge cleaning roller 29 is rotated by the rotation of the charging roller 27. However, the present invention is not limited to this mechanism. For example, the charge cleaning roller 29 may be rotated by a driving unit for the charge cleaning roller 29, and a direction in which the charge cleaning roller 29 is rotated may be in a same direction or in an opposite direction as the rotation direction of the charging roller 27.

The developing unit 22 includes a developing roller 30 that stores a toner together with a carrier, and that supplies the toner to the photosensitive element 20. As the toner, a toner formed by a pulverizing method or a polymerized toner that has a small mean particle diameter and a high circularity, produced by a polymerization method, can be used. The polymerized toner makes it possible to produce a high quality image. If the polymerized toner is used, since the polymerized toner deposits well on the surface of the photosensitive element 20, it is important to apply a lubricant on the surface for improving cleanability in removing a residual toner on the surface after each image transfer. The lubricant is to improve separation of the toner from the photosensitive element 20 or to decrease coefficient of friction on the surface of the photosensitive element 20.

The cleaning unit 23 includes a lubricant applying unit 31, a cleaning blade 32 that cleans an image carrier, a residual toner transfer screw (not shown) that reclaims the residual toner, and the like.

The lubricant applying unit 31 includes a cleaning brush 33 that applies the lubricant, a solid lubricant 34 that is arranged in a position opposite to the cleaning brush 33, an abutment member 35 that supports the solid lubricant 34 such that the solid lubricant 34 come in contact with the cleaning brush 33, and the like. A lubricant application mechanism is implemented with the cleaning brush 33 and the abutment member 35. The abutment member 35 includes a support member 36 that supports the solid lubricant 34, a spring 37 that presses the support member 36 toward the cleaning brush 33, and the like. In the lubricant applying unit 31, the solid lubricant 34 is pressed by the spring 37 toward the cleaning brush 33, and some of the lubricant is rubbed off by the cleaning brush 33 from a surface of the solid lubricant 34. The lubricant is applied on the surface of the photosensitive element 20 by the cleaning brush 33. This simple arrangement realizes uniform application of the lubricant to the photosensitive element 20.

The cleaning brush 33 is arranged in such a manner that a center axis of the cleaning brush 33 is parallel to a center axis of the photosensitive element 20. A periphery of the cleaning brush 33 contacts with the surface of the photosensitive element 20, and is rotatable corresponding to rotation of the photosensitive element 20. The cleaning brush 33 has functions of removing a part of the residual toner on the surface of the photosensitive element 20, and of applying the lubricant on the surface of the photosensitive element 20.

The solid lubricant 34 is obtained by solidifying the lubricant substantially in a rectangular parallelepiped. The lubricant is formed with carnauba wax, which is a granule, a silicone powder, which is silicon based powder, or the like. Particularly, the silicone powder is less likely to adhere to the charging roller 27 because the silicone powder is spherical; therefore, contact area with the charging roller 27 is small. Furthermore, even if the silicone powder adheres on the charging roller 27, it can rotate because of an excellent surface sliding effect of the silicon resin. The solid lubricant 34 is arranged such that a longitudinal direction of the solid lubricant 34 corresponds with an axial direction of the cleaning brush 33, and that the surface thereof the solid lubricant 34 contacts with a periphery of the cleaning brush 33.

The solid lubricant 34 is pushed toward the cleaning brush 33 by the spring 37. When the cleaning brush 33 in contact with the solid lubricant 34 rotates about the axis, some of the lubricant is rubbed off from the surface of the solid lubricant 34. The lubricant rubbed adheres to the cleaning brush 33, and the lubricant is applied on the surface of the photosensitive element 20 while the cleaning brush 33 rotates. The lubricant reduces the coefficient of friction on the surface of the photosensitive element 20.

The cleaning blade 32 is formed in a flat shape with an elastic material such as rubber or urethane. One of edges of the cleaning blade 32 abuts against the surface of the photosensitive element 20 in whole area along the axial direction of the photosensitive element 20. While the photosensitive element 20 rotates, the cleaning blade 32 removes the residual toner that still remains on the surface of the photosensitive element 20, which is the residual toner missed to be removed by the cleaning brush 33.

The residual toner is carried to near the residual toner transfer screw. The residual toner transfer screw transfers the residual toner toward a residual toner reclaiming unit (not shown) in a direction in which the residual toner is reclaimed, that is along the axial direction of the cleaning brush 33. The transfer unit 15 transfers the toner image formed on the surface of the photosensitive element 20 to a recording medium, and the fixing unit 16 fixes the toner image on the recording medium.

When an original document is set on the contact glass 6 and the start key is turned on, the image reader 4 reads an image of the document. Then, the optical writing unit 18 emits laser beams based on image data obtained by reading the image, and the laser beams are irradiated onto the surface of the photosensitive element 20 that is uniformly charged by the charging unit 21. An electrostatic latent image is formed on the surface of the photosensitive element 20 by the irradiation of the laser beams. The toner that supplied from the developing unit 22 is deposited on the electrostatic latent image, and thus, a toner image is formed on the surface of the photosensitive element 20. The toner image is transferred by the transfer unit 15 to the recording medium that is carried by the resist roller 13 at proper timing. The toner image transferred is fixed by the fixing unit 16, and then, the recording medium is ejected to the recording medium outlet 5 by the ejection roller 17.

In the image forming operation, the residual toner on the surface of the photosensitive element 20 after an image transfer by the transfer unit 15 is removed by the cleaning brush 33 and the cleaning blade 32. At the same time, the lubricant rubbed off from the solid lubricant 34 by the cleaning brush 33 is applied to the surface of the photosensitive element 20. Thus, both separation of the toner from the photosensitive element 20 and cleanability in removing the residual toner on the surface of the photosensitive element 20 are improved. Furthermore, the coefficient of friction on the surface of the photosensitive element 20 can be reduced, and as a result, wear of the photosensitive element 20 and the cleaning blade 32 can be suppressed.

If zinc stearate is used as the lubricant as in the conventional example, the lubricant is likely to adhere on the charging roller 27. The lubricant on the charging roller 27 causes a change in the resistance of the entire charging roller 27 to cause the insufficient charge. In the embodiment, since a carnauba wax or the silicone powder is used as the lubricant, the lubricant is less likely to adhere on the charging roller 27. Consequently, adhesion of the lubricant to the charging roller 27 can be suppressed, and thus, the insufficient charge of the charging roller 27 can be prevented. As a result, a lifetime of the charging roller 27 can be increased.

Even if the lubricant adheres on the charging roller 27, the charge cleaning roller 29 removes the lubricant. Thus, the insufficient charge of the charging roller 27 can be reliably prevented.

The photosensitive element 20, the charging unit 21, and the like are arranged in the cartridge case 19, and are provided in the form of the process cartridge 14. As a result, maintenance of the copier 1 becomes easy compared to an apparatus in which the photosensitive element 20, the charging unit 21, and the like are arranged independently. When a failure attributed to the parts in the process cartridge 14 occurs in the copier 1, the copier can be recovered in an early stage just by replacing the process cartridge 14. Therefore, time required for the maintenance can be shortened. Furthermore, excellent cleanability of the photosensitive element 20 realizes a long life of the process cartridge 14.

Adhesive property of the lubricant with respect to the charging roller 27 was examined by experiments.

With an image forming apparatus (for example, NX720, manufactured by Ricoh Company, Ltd.) that is obtained by removing the image reader 4 and the charge cleaning roller 29 from the copier 1 according to the embodiment, letting a lubricant adhere on a part of the surface the charging roller 27, difference in image density, which indicates the adhesive property), between portions with and without the lubricant adhered was measured when a halftone image was output. As the lubricant, zinc stearate, carnauba wax No. 1, carnauba wax No. 2, or carnauba wax No. 3) that is a granule, and a silicone powder (a silicone powder 1, a silicone powder 2, or a silicone powder 3) were used. The lubricant was applied to the charging roller 27 by reciprocating a pressing member that applies a predetermined pressure, by a spring, to the lubricant that was arranged between the pressing member and the charging roller 27, in a longitudinal direction of the charging roller 17 for 30 times.

<Characteristic value of silicone powder 1>
Shape: amorphous
Mean particle diameter: 40 μm
Particle size distribution: 1 to 100 μm
True specific gravity: 0.97
Water content: 0.1%.
<Characteristic value of silicone powder 2>
Shape: spherical
Mean particle diameter: 30 μm
Volatile matter: 1% or less.
<Characteristic Value of Silicone Powder 3>
Shape: spherical
Mean particle diameter: 30 μm
Particle size distribution: 4 to 60 μm
True specific gravity: 0.98
Water content: 0.1%.
Physical property of carnauba wax No. 1
Melting point (minimum): 83° C.
Flash point (minimum): 310° C.
Acid value: 2 to 6
Saponification value: 78 to 88
Paraffin hydrocarbon (maximum %): 2
Pitch (maximum %): 3.5
Solubility in benzene (maximum %): 8.0.
Physical Property of Carnauba Wax Nos. 2 and 3
Melting point (minimum): 82.5° C.
Flash point (minimum): 299° C.
Acid value: 4 to 10
Saponification value: 78 to 88
Paraffin hydrocarbon (maximum %): 2
Pitch (maximum %): 3.5
Solubility in benzene (maximum %): 8.0.

Common Among Carnauba Waxes Nos. 1 to 3

Number-average molecular weight (Mn): $4.2\times10^2$

Weight-average molecular weight (Mw): $5.7\times10^2$

Mw/Mn: 1.4.

As a result, the difference in the image density for each of the lubricant was obtained. When zinc stearate was used, the difference was 0.16, and when the carnauba wax and three kinds of the silicone powder were used, the difference was 0.05 or less. Therefore, it is clearly found that the carnauba wax and three kinds of the silicone powder are less likely to adhere to the charging roller 27 compared to zinc stearate. When the difference in the image density is 0.05 or less, it is hardly recognized by visual observation.

To observe difference in cleanability of the charging roller 27 depending on the type of the lubricant, zinc stearate, carnauba wax, and three kinds of silicone powder were applied to a part of the charging roller 27 by the method described above. Thus, a portion with the lubricant adhered and a portion without the lubricant are formed on the surface of the charging roller 27, and then, the portion with the lubricant adhered was cleaned by the charge cleaning roller 29. The difference in image density, which indicates the cleanability, between the portion cleaned and the portion originally without the lubricant was measured. The charging roller 27 was cleaned by rubbing the charge cleaning roller 29 once in a direction perpendicular to the longitudinal direction of the charging roller 27 at a predetermined pressure.

As a result, the difference in the image density of each of the lubricants was obtained. When zinc stearate was used, the difference was 0.071, and when the carnauba wax and the three kinds of silicone powder were used, the difference was 0.02 or less. Therefore, it is clearly found that the carnauba wax and three kinds of the silicone powder can be cleaned more easily than zinc stearate. When the difference in the image density is 0.05 or less, it is hardly recognized by visual observation.

The coefficient of friction on the surface of the photosensitive element 20 when the lubricant was applied on the photosensitive element 20 was as follows. The coefficient of friction was 0.0834 when zinc stearate was applied, 0.145 when the carnauba wax was applied, and 0.100 to 0.145 when each of the three kinds of the silicone powder was applied. The coefficient of friction without application of the lubricant was 0.300.

With the carnauba wax and three kinds of the silicone powder as the lubricant in the embodiment, although the coefficient of friction is slightly higher than that of zinc stearate, the coefficient of friction is still as small as half or less than half of the coefficient of friction without the lubricant, and the cleanability can be considerably improved.

Accordingly, it is possible to use a polymerized toner that is hard to clean. Thus, it is possible to realize the lubricant applying unit 31 that has the charging roller 27 with excellent fouling-resistant characteristics, that can reduce the coefficient of friction on the surface of the photosensitive element 20 sufficiently, and that is excellent in the cleanability by using the silicon-based-powder or the silicon-based-granule as the lubricant. Moreover, it is possible to obtain a more favorable lubricant applying unit 31 if a silicon-based-powder having a mean particle diameter of from 30 μm to 40 μm, or a silicon-based-granule having a weight-average molecular weight of about $5.7\times10^2$ is used as the lubricant.

According to the present invention, the charging unit can be prevented from being insufficiently charged, and a life of the charging unit can be increased.

Moreover, according to the present invention, the lubricant can be uniformly applied on the image carrier with a simple configuration.

Furthermore, according to the present invention, high image quality can be realized.

Moreover, according to the present invention, the image carrier and the lubricant applying unit can be easily replaced, thereby reducing the replacement time.

Furthermore, according to the present invention, even when the lubricant adheres on the surface of the charging unit, the lubricant can be removed therefrom. As a result, the charging unit can be reliably prevented from being charged insufficiently.

Moreover, according to the present invention, the lubricant can be efficiently removed, and as a result, high image quality can be maintained over a long period of time.

Furthermore, according to the present invention, a damage of the charging unit can be suppressed.

Moreover, according to the present invention, foreign matter adhered on the charging unit, for example a lubricant, can be reliably removed.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A process cartridge comprising:

an image carrier that carries an image;

a charging roller abutting the image carrier;

a cartridge case that holds the image carrier in such a manner that the image carrier is freely revolved;

a first solid lubricant that is obtained by solidifying a second lubricant including a silicone powder into a substantially rectangular parallelepiped, wherein the silicone powder comprises spherical particles having an average particle diameter greater than 10 μm; and a lubricant applying unit that is held in the cartridge case, the lubricant applying unit including an application mechanism that rubs the second lubricant from a surface of the first solid lubricant and that applies the second lubricant on a surface of an image carrier that carries an image.

2. The process cartridge according to claim 1, wherein the cartridge case holds at least one of a charging unit that charges the surface of the image carrier, a developing unit that supplies a toner onto the surface of the image carrier, and a first cleaning unit that cleans the surface of the image carrier.

3. The process cartridge according to claim 1, wherein the silicone powder has an average grain diameter of from 30 μm to 40 μm.

4. An image forming apparatus comprising:

a process cartridge that is detachably mounted on the image forming apparatus, the process cartridge including an image carrier that carries an image;

a cartridge case that holds the image carrier in such a manner that the image carrier is freely revolved;

a first solid lubricant that is obtained by solidifying a second lubricant including a silicone powder into a substantially rectangular parallelepiped, wherein the silicone powder comprises spherical particles having an average particle diameter greater than 10 μm;

a lubricant applying unit that is held in the cartridge case and that rubs the second lubricant from a surface of the first solid lubricant and, the lubricant applying unit including an application mechanism that applies the second lubricant on a surface of an image carrier that carries an image;

a charging unit that charges the surface of the image carrier based on image data;

an optical writing unit that performs optical writing on the surface of the image carrier charged;

a developing unit that supplies a toner onto the surface of the image carrier, on which the optical writing has been performed, to form a toner image;

a transfer unit that transfers the toner image formed on the surface of the image carrier onto a recording medium;

a fixing unit that fixes the toner image transferred onto the recording medium; and a first cleaning unit that cleans the surface of the image carrier.

5. The image forming apparatus according to claim 4, wherein the cartridge case holds at least one of the charging unit, the developing unit, and the first cleaning unit.

6. The image forming apparatus according to claim 4, wherein the silicone powder has an average grain diameter of from 30 μm to 40 μm.

7. An image forming apparatus comprising:

an image carrier that carries an image;

a first solid lubricant that is obtained by solidifying a second lubricant including a silicone powder into a substantially rectangular parallelepiped, wherein the silicone powder comprises spherical particles having an average particle diameter greater than 10 μm;

a lubricant applying unit that rubs the second lubricant from a surface of the first solid lubricant and that includes an application mechanism that applies the second lubricant on a surface of the image carrier;

a charging unit that charges the surface of the image carrier based on image data;

an optical writing unit that performs optical writing on the surface of the image carrier charged;

a developing unit that supplies a toner onto the surface of the image carrier, on which optical writing has been performed, to form a toner image;

a transfer unit that transfers the toner image formed on the surface of the image carrier onto a recording medium;

a fixing unit that fixes the toner image transferred on the recording medium; and a first cleaning unit that cleans the surface of the image carrier.

8. The image forming apparatus according to claim 7, further comprising a second cleaning unit that cleans a surface of the charging unit.

9. The image forming apparatus according to claim 8, wherein the second cleaning unit is a rotor that is rotatably arranged in such a manner that the second cleaning unit makes a contact with the charging unit.

10. The image forming apparatus according to claim 8, wherein the second cleaning unit is made of a foam.

11. The image forming apparatus according to claim 8, wherein the second cleaning unit is a brush.

12. The image forming apparatus according to claim 7, wherein the silicone powder has an average grain diameter of from +μm to 40 μm.

* * * * *